US006109361A

United States Patent [19]

Henderson

[11] Patent Number: 6,109,361

[45] Date of Patent: Aug. 29, 2000

[54] EXTERIOR FIRE PROTECTION SYSTEM FOR BUILDINGS

[76] Inventor: Kenneth Henderson, 1100 W. Bennett St., Compton, Calif. 90220

[21] Appl. No.: 09/379,547

[22] Filed: Aug. 23, 1999

[51] Int. Cl.[7] ..... A62C 37/00; A62C 35/00; B05B 15/10; B05B 3/06; B05B 15/00

[52] U.S. Cl. ..... 169/54; 169/17; 169/18; 239/208; 239/251; 239/289

[58] Field of Search ..... 239/208, 209, 239/210, 237, 240, 251, 289, 536; 169/41, 54, 70, 16–18

[56] References Cited

U.S. PATENT DOCUMENTS

| | | | |
|---|---|---|---|
| 1,178,344 | 4/1916 | Perry | 239/240 |
| 4,893,680 | 1/1990 | Wiltbrodt et al. | 169/60 |
| 4,945,675 | 8/1990 | Kendrick | 47/33 |
| 4,991,657 | 2/1991 | LeLande, Jr. | 169/54 |
| 5,125,458 | 6/1992 | Berman | 169/16 |
| 5,263,543 | 11/1993 | Nigro | 169/56 |
| 5,692,571 | 12/1997 | Jackson | 169/16 |
| 5,732,511 | 3/1998 | Scott | 52/1 |

*Primary Examiner*—Andres Kashnikow
*Assistant Examiner*—Davis Hwu
*Attorney, Agent, or Firm*—Joseph N. Breaux

[57] ABSTRACT

A fire protection system for the exterior of a building that provides protection from fires by sprinkling the exterior of the building with water. The fire protection system includes a number of sprinkler heads that each also include a light source for providing illumination as needed.

1 Claim, 4 Drawing Sheets

EXTERIOR FIRE PROTECTION SYSTEM FOR BUILDINGS

TECHNICAL FIELD

The present invention relates to fire protection systems and more particularly to an exterior fire protection system for buildings that includes a system controller, a servo actuated water supply line valve in controlled electrical connection with the system controller and in fluid parallel connection with a manual water supply line valve, a water distribution piping system in connection with the outputs of the servo actuated water supply line valve and the manual water supply line valve, and a number of combination light fixture sprinkler head assemblies having a fluid connection with the water distribution piping system and an electrical connection with the system controller; each of the combination light fixture sprinkler head assemblies including a tubular, fixed piping system connecting structure, a rotatably connected sprinkler head structure rotatably mounted onto the tubular, fixed piping system connecting structure, and a fixed strobe light fixture assembly positioned above the sprinkler head structure and in electrical connection with the system controller through electrical wiring routed through a section of the water distribution piping system, the sprinkler head structure and the tubular, fixed piping system connecting structure; the tubular, fixed piping system connecting structure having one inlet opening at a water distribution piping connecting end and four spaced outlet openings provided through an enlarged distribution end; the sprinkler head structure being rotatably mounted onto the tubular, fixed piping system connecting structure with a bearing assembly positioned around a center section of the tubular, fixed piping system connecting structure located between the water distribution piping connecting end and the enlarged distribution end; the sprinkler head structure including four spray heads each having a nozzle oriented to cause the sprinkler head structure to rotate about the tubular, fixed piping system connecting structure.

BACKGROUND ART

Each year fires that spread between adjacent buildings and/or from burning trees and vegetation near the building cause millions of dollars worth of property damage. It would be a benefit, therefore, to have a fire protection system for the exterior of a building that could provide protection from such fires by sprinkling the exterior of the building with water. In addition, because the fire could be at night, it would be a further benefit to have a fire protection system that included a number of sprinkler heads that also included a light source for providing illumination as needed.

GENERAL SUMMARY DISCUSSION OF INVENTION

It is thus an object of the invention to provide an exterior fire protection system for buildings that includes a system controller, a servo actuated water supply line valve in controlled electrical connection with the system controller and in fluid parallel connection with a manual water supply line valve, a water distribution piping system in connection with the outputs of the servo actuated water supply line valve and the manual water supply line valve, and a number of combination light fixture sprinkler head assemblies having a fluid connection with the water distribution piping system and an electrical connection with the system controller; each of the combination light fixture sprinkler head assemblies including a tubular, fixed piping system connecting structure, a rotatably connected sprinkler head structure rotatably mounted onto the tubular, fixed piping system connected structure, and fixed strobe light fixture assembly positioned above the sprinkler head structure and in electrical connection with the system controller through electrical wiring routed through a section of the water distribution piping system, the sprinkler head structure and the tubular, fixed piping system connecting structure; the tubular, fixed piping system connecting structure having one inlet opening at a water distribution piping connecting end and four spaced outlet openings provided through an enlarged distribution end; the sprinkler head structure being rotatably mounted onto the tubular, fixed piping system connecting structure with a bearing assembly positioned around a center section of the tubular, fixed piping system connecting structure located between the water distribution piping connecting end and the enlarged distribution end; the sprinkler head structure including four spray heads each having a nozzle oriented to cause the sprinkler head structure to rotate about the tubular, fixed piping system connecting structure.

Accordingly, an exterior fire protection system for buildings is provided. The exterior fire protection system for buildings includes a system controller, a servo actuated water supply line valve in controlled electrical connection with the system controller and in fluid parallel connection with a manual water supply line valve, a water distribution piping system in connection with the outputs of the servo actuated water supply line valve and the manual water supply line valve, and a number of combination light fixture sprinkler head assemblies having a fluid connection with the water distribution piping system and an electrical connection with the system controller; each of the combination light fixture sprinkler head assemblies including a tubular, fixed piping system connecting structure, a rotatably connected sprinkler head structure rotatably mounted onto the tubular, fixed piping system connecting structure, and a fixed strobe light fixture assembly positioned above the sprinkler head structure and in electrical connection with the system controller through electrical wiring routed through a section of the water distribution piping system, the sprinkler head structure and the tubular, fixed piping system connecting structure; the tubular, fixed piping system connecting structure having one inlet opening at a water distribution piping connecting end and four spaced outlet openings provided through an enlarged distribution end; the sprinkler head structure being rotatably mounted onto the tubular, fixed piping system connecting structure with a bearing assembly positioned around a center section of the tubular, fixed piping system connecting structure located between the water distribution piping connecting end and the enlarged distribution end; the sprinkler head structure including four spray heads each having a nozzle oriented to cause the sprinkler head structure to rotate about the tubular, fixed piping system connecting structure.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
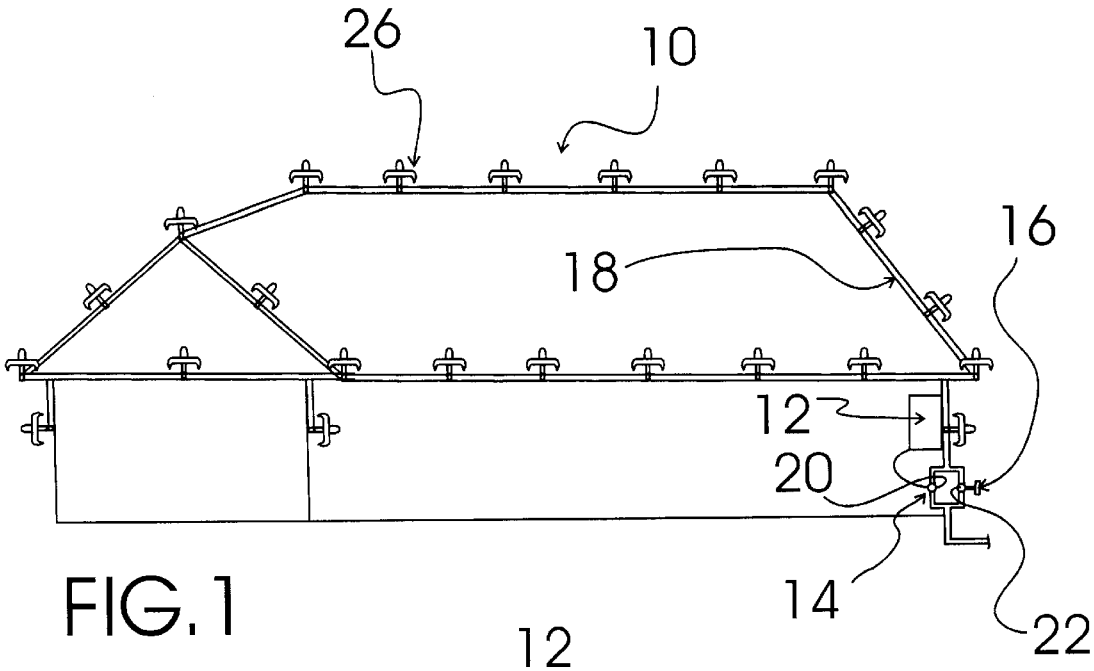
FIG. 1 is a perspective view of an exemplary embodiment of the exterior fire protection system for buildings of the present inventions showing the system controller, the servo actuated water supply line valve in controlled electrical connection with the system controller and in fluid parallel connection with a manual water supply line valve, the water distribution piping system in connection with the outputs of the servo actuated water supply line valve and the manual water supply line valve, and a number of combination light fixture sprinkler head assemblies having a fluid connection with the water distribution piping system and an electrical connection with the system controller; each of the combination light fixture sprinkler head assemblies including a tubular, fixed piping system connecting structure, a rotatably connected sprinkler head structure rotatably mounted onto the tubular, fixed piping system connecting structure, and a fixed strobe light fixture assembly positioned above the sprinkler head structure and in electrical connection with the system controller through electrical wiring routed through a section of the water distribution piping system, the sprinkler head structure and the tubular, fixed piping system connecting structure; the tubular, fixed piping system connecting structure having one inlet opening at a water distribution piping connecting end and four spaced outlet openings provided through an enlarged distribution end; the sprinkler head structure being rotatably mounted onto the tubular, fixed piping system connecting structure with a bearing assembly positioned around a center section of the tubular, fixed piping system connecting structure located between the water distribution piping connecting end and the enlarged distribution end; the sprinkler head structure including four spray heads each having a nozzle oriented to cause the sprinkler head structure to rotate about the tubular, fixed piping system connecting structure.

FIG. 1 shows an exemplary embodiment of the exterior fire protection system for buildings of the present invention generally designated 10. Exterior fire protection system for buildings 10 includes a system controller, generally designated 12; a servo actuated water supply line valve, generally designated 14, in controlled electrical connection with system controller 12 and in fluid parallel connection with a manual water supply line valve 16; a water distribution piping system, generally designated 18, in connection with the outlets 20,22, respectively, of servo actuated water supply line valve 14 and manual water supply line valve 16; and a number of combination light fixture sprinkler head assemblies, each generally designated 26, having a fluid connection with water distribution piping system 18 and an electrical connection with system controller 12.

Figure 2:
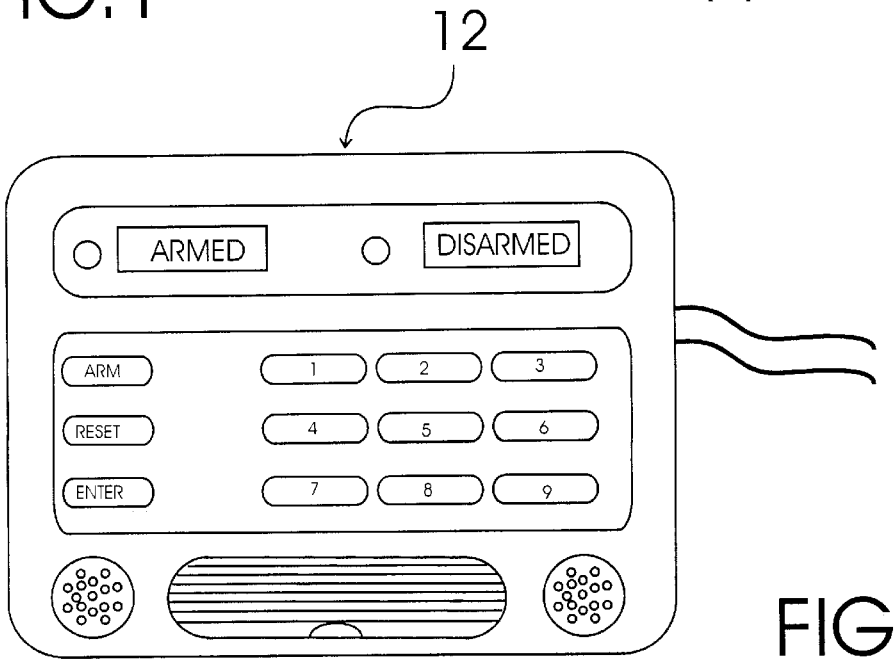
FIG. 2 is a front plan view of the system controller in isolation.
Figure 3:
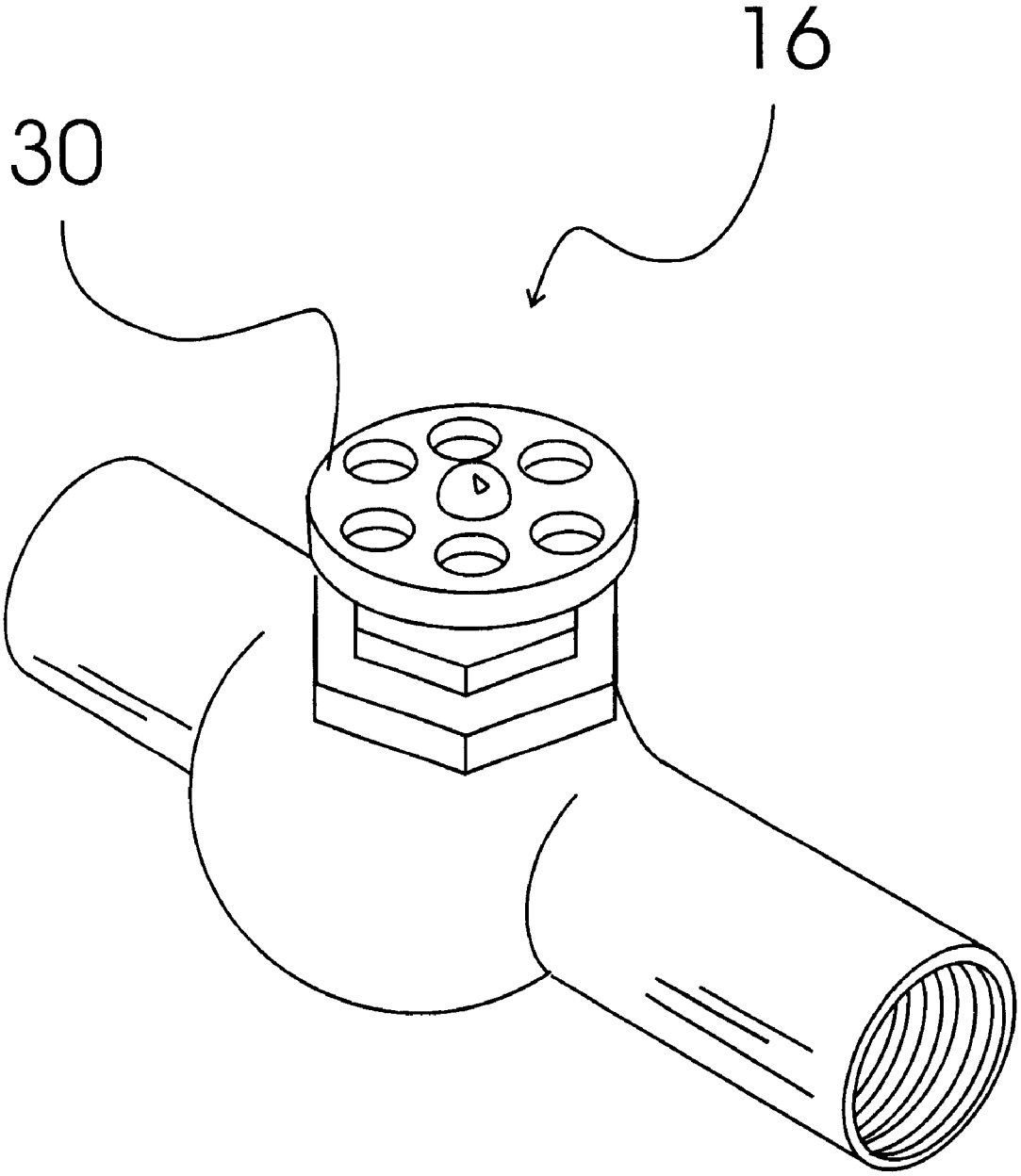
FIG. 3 is a perspective view of the manual water supply valve in isolation.

Referring to FIG. 2, system controller 12 is a conventional fire alarm system controller having an output configured to drive the conventional servo actuated valve used as servo actuated water supply line valve 14 (FIG. 1) in this embodiment. Referring to FIG. 3, manual water supply line valve 16 is a conventional water valve with a manually rotatable valve stem 30.

Figure 4:
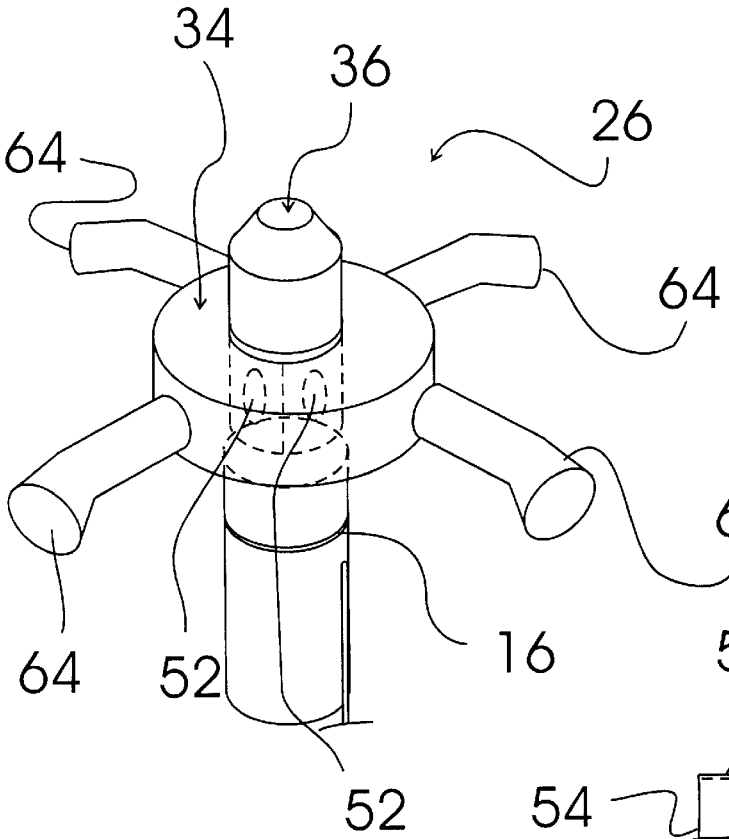
FIG. 4 is a perspective view of one of the number of combination light fixture sprinkler head assemblies in isolation.
Figure 6:
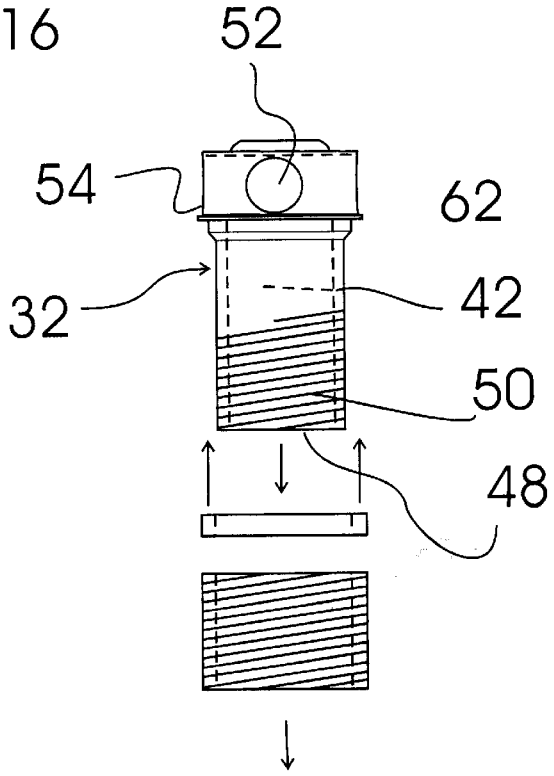
FIG. 6 is an exploded plan view showing the bearing assembly, the gasket, and the tubular, fixed piping system connecting structure including the center section, the water distribution piping connecting end and the enlarged distribution end.
Figure 5:
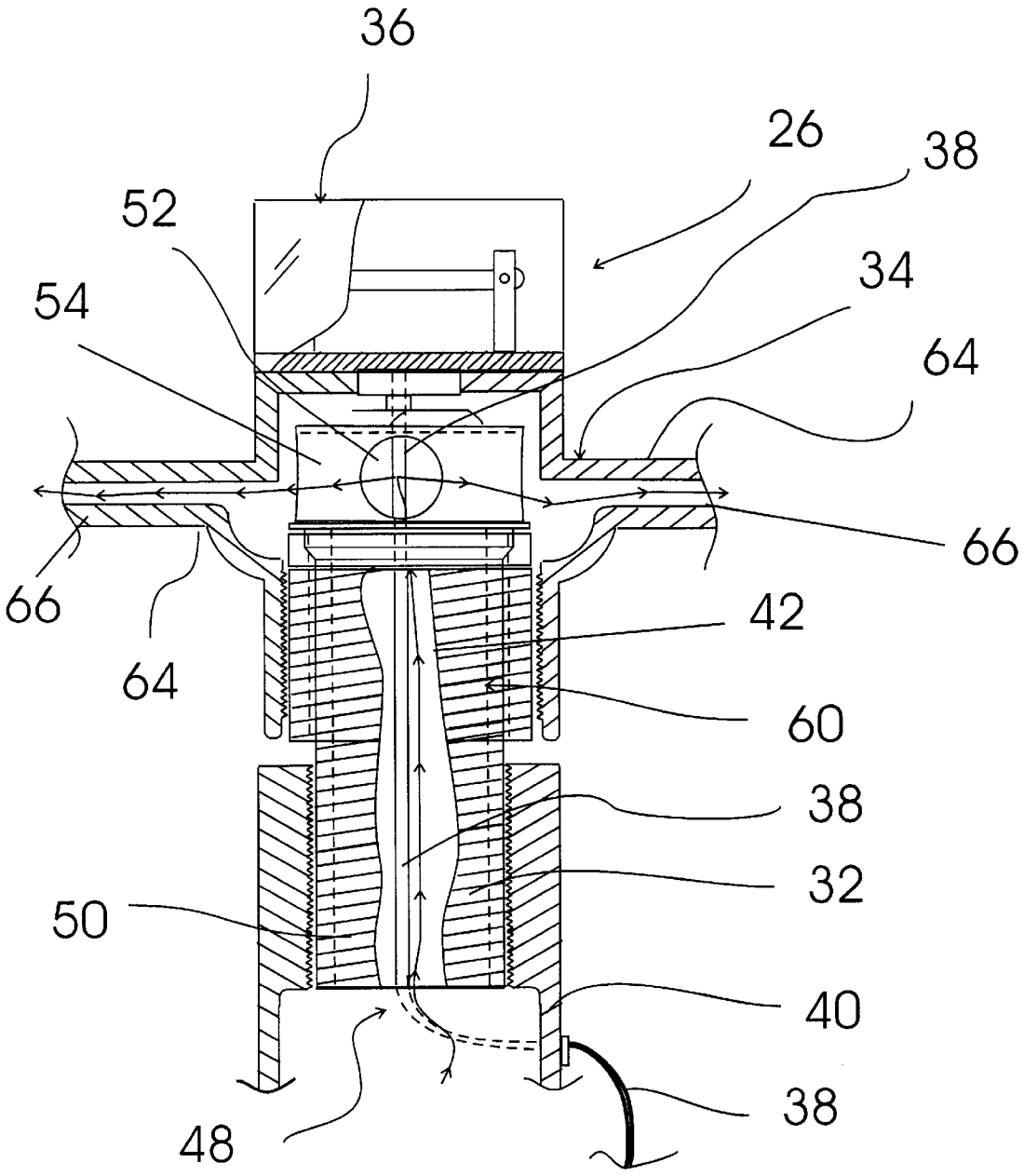
FIG. 5 is a cut away view of one of the number of combination light fixture sprinkler head assemblies in isolation.

Referring to FIGS. 4–6, each of the number of combination light fixture sprinkler head assemblies 26 includes a tubular, fixed piping system connecting structure, generally designated 32; a rotatably connected sprinkler head structure, generally designated 34; and a fixed strobe light fixture assembly, generally designated 36, positioned above sprinkler head structure 34 and in electrical connection with the system controller 12 (FIGS. 1 and 2) through electrical wiring 38 routed through a section of the water distribution piping system 40, the sprinkler head structure 34 and the passageway 42 (shown in dashed lines FIGS. 5 and 6) through tubular, fixed piping system connecting structure 32. Tubular, fixed piping system connecting structure 32 has one inlet opening 48 at a water distribution piping connecting end 50 and four spaced outlet openings 52 provided through an enlarged distribution end 54. Sprinkler head structure 34 is rotatably mounted onto tubular, fixed piping system connecting structure 32 with a bearing assembly 60 positioned around a center section 62 of tubular, fixed piping system connecting structure 62 located between water distribution piping connecting end 50 and enlarged distribution end 54. Sprinkler head structure 34 includes four spray heads 64 each having a nozzle end 66 oriented to cause the sprinkler head structure 34 to rotate about the tubular, fixed piping system connecting structure 32.

It can be seen from the preceding description that an exterior fire protection system for buildings has been provided that includes a system controller, a servo actuated water supply line valve in controlled electrical connection with the system controller and in fluid parallel connection with a manual water supply line valve, a water distribution piping system in connection with the outputs of the servo actuated water supply line valve and the manual water supply line valve, and a number of combination light fixture sprinkler head assemblies having a fluid connection with the water distribution piping system and an electrical connection with the system controller; each of the combination light fixture sprinkler head assemblies including a tubular, fixed piping system connecting structure, a rotatably connected sprinkler head structure rotatably mounted onto the tubular, fixed piping system connecting structure, and a fixed strobe light fixture assembly positioned above the sprinkler head structure and in electrical connection with the system controller through electrical wiring routed through a section of the water distribution piping system, the sprinkler head structure and the tubular, fixed piping system connecting structure; the tubular, fixed piping system connecting structure having one inlet opening at a water distribution piping connecting end and four spaced outlet openings provided through an enlarged distribution end; the sprinkler head structure being rotatably mounted onto the tubular, fixed piping system connecting structure with a bearing assembly positioned around a center section of the tubular, fixed piping system connecting structure located between the water distribution piping connecting end and the enlarged distribution end; the sprinkler head structure including four spray heads each having a nozzle oriented to cause the sprinkler head structure to rotate about the tubular, fixed piping system connecting structure.

It is noted that the embodiment of the exterior fire protection system for buildings described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An exterior fire protection system for buildings comprising:

a system controller;

a servo actuated water supply line valve in controlled electrical connection with said system controller and in fluid parallel connection with a manual water supply line valve;

a water distribution piping system in connection with an outlet of each of said servo actuated water supply line valve and said manual water supply line valve; and a number of combination light fixture sprinkler head assemblies having a fluid connection with said water distribution piping system and an electrical connection with said system controller;

each of said combination light fixture sprinkler head assemblies including a tubular, fixed piping system connecting structure, a rotatably connected sprinkler head structure rotatably mounted onto said tubular, fixed piping system connecting structure, and a fixed strobe light fixture assembly positioned above said sprinkler head structure and in electrical connection with said system controller through electrical wiring routed through a section of said water distribution piping system, said sprinkler head structure and said tubular, fixed piping system connecting structure;

said tubular, fixed piping system connecting structure having one inlet opening at a water distribution piping connecting end and four spaced outlet openings provided through an enlarged distribution end;

said sprinkler head structure being rotatably mounted onto said tubular, fixed piping system connecting structure with a bearing assembly positioned around a center section of said tubular, fixed piping system connecting structure located between said water distribution piping connecting end and said enlarged distribution end;

said sprinkler head structure including four spray heads each having a nozzle oriented to cause said sprinkler head structure to rotate about said tubular, fixed piping system connecting structure.

* * * * *